United States Patent [19]

Henderson et al.

[11] Patent Number: 4,790,508

[45] Date of Patent: Dec. 13, 1988

[54] CONCRETE CASTING FORM INCLUDING RETRACTABLE CORE

[76] Inventors: Don Henderson, 822 Anclote Rd., Tarpon Springs, Fla. 33589; Dirk Henderson, 195 E. Canal Dr., Palm Harbor, Fla. 33563

[21] Appl. No.: 935,925

[22] Filed: Nov. 28, 1986

[51] Int. Cl.[4] ..... B28B 7/30

[52] U.S. Cl. ..... 249/11; 249/27; 249/101; 249/153; 249/172; 249/176; 249/179; 249/183

[58] Field of Search ..... 249/27, 63, 64, 98, 249/11, 144, 150, 151, 153, 170–172, 176, 179, 183, 101

[56] References Cited

U.S. PATENT DOCUMENTS

| | | | |
|---|---|---|---|
| 2,219,106 | 10/1940 | Kruckenberg | 249/153 |
| 2,559,296 | 7/1951 | Hansen | 249/153 |
| 2,578,310 | 12/1951 | Lager | 249/179 |
| 2,807,071 | 9/1957 | Francis et al. | 249/172 |
| 3,288,425 | 11/1966 | Dorris | 249/153 |
| 3,298,656 | 1/1967 | Zastrow | 249/172 |

*Primary Examiner*—Jay H. Woo
*Assistant Examiner*—James C. Housel
*Attorney, Agent, or Firm*—Frijouf, Rust & Pyle

[57] ABSTRACT

A core form is disclosed for casting a structurally reinforced concrete structure for use on a slab with an outer container form having rigid walls extending vertically comprising a casting core positioned internal the outer form and having vertically extending resilient walls defining an within contiguous core wall. The walls of the outer form and the walls of the casting core are spaced apart to define a mold cavity therebetween. A form base supported by the slab is positioned within the mold cavity to releasingly support the concrete structure to be formed and cured within the mold cavity. The walls of the casting core include an upper and lower periphery such that in use the lower periphery abuts the form base to seal the concrete internal the mold cavity relative the periphery and form base. The internal contiguous core wall is retractable to enable the placement of the reinforcing structure within the mold cavity. Prior to pouring concrete into the mold cavity the walls of the outer form and the contiguous core walls are positioned and braced. After the concrete has cured the internal contiguous core wall of the casting core is retracted and the walls of the outer form are positioned to enable the cast reinforced concrete structure to be removed. A means for extending and retracting the walls of the casting core during the pouring and curing of the concrete and for bracing the walls of the casting core when the concrete is cured are disclosed. A particular outer form is also disclosed.

17 Claims, 4 Drawing Sheets

CONCRETE CASTING FORM INCLUDING RETRACTABLE CORE

BACKGROUND OF THE INVENTION

1. Field of the Invention

This invention relates to a casting core and more particularly to a core and form base to be used with an outer form. The casting core permits the insertion of structural reinforcement material within a mold cavity prior to placing concrete, or the like, about the structural reinforcement and enables easy removal of the curved cast reinforced concrete structure without disassembling the casting core.

2. Information Disclosure Statement

A number of casting cores are in use which permit the casting of structurally reinforced concrete structures. A number of casting cores utilize slidable wall sections which are subject to clogging and binding thereby requiring greater preparation between castings to prepare for another casting.

U.S. Pat. No. 764,193 utilizes a plurality of expansible and contractible spring-actuated overlapping sections.

U.S. Pat. No. 3,814,374 teaches a retractable core which utilizes elastomeric joint seals.

U.S. Pat. No. 4,519,570 teaches a particular corner member which links the form panels to enable the panels to be stripped from the hardened concrete.

U.S. Pat. No. 3,565,390 teaches a core with diagonally movable walls.

U.S. Pat. No. 4,055,321 teaches a core wall form with a particular three-way hinge assembly.

U.S. Pat. No. 2,818,627 teaches a core with a plurality of hinges to enable the core to collapse.

U.S. Pat. No. 3,288,425 teaches a core with expanding and contracting tapered walls. The core is used with an outer form. The casting may be used as a pontoon in constructing floats, wharves, and the like.

Accordingly, it is a primary object of this invention to provide a casting form comprising an outer form and core form or casting core which alleviates the inadequacies of the prior art.

It is a further object of this invention to provide a casting form which does not have to be dismissed in order to provide for the placement of structural reinforcement material within the mold cavity.

It is a further object of this invention to provide a casting form which does not have to be dissembled in order to release and remove the cured reinforced concrete structure from the form.

It is a further object of this invention to provide a casting form which funnels uncured concrete into the mold cavity.

It is a further object of this invention to provide a casting form so constructed to permit reuse of the form without reassembly after removing the casting therefrom.

It is a further object of this invention to provide a casting form having an outer form and inner form (core form) which enables the cured casting to be easily and quickly removed from the casting form.

It is a further object of this invention to provide a casting core which casts vertical walls without the use of overlapping form panels which may interlock with the casting.

It is a further object of this invention to provide a casting core which casts a core having vertical walls without the requirement of articulating or slidable panels or other areas which are subject to clogging and binding thereby requiring greater preparation between castings to clean and prepare for another casting.

It is a further object of this invention to provide a casting form for casting a steel reinforced concrete box culvert.

It is a further object of this invention to provide a casting form which consistently casts a concrete casting of a predetermined dimension while maintaining a high tolerance between the castings.

It is a further object of this invention to provide a casting form so constructed to not require reassembly of disassembly between castings.

It is a further object of this invention to provide a casting form having an internal casting core to enable repeated casting without substantial wall thickness variance among the castings.

It is a further object of this invention to provide a casting form to provide for a contiguous multi-thickness wall casting.

It is a further object of this invention to provide a casting form which enables the positioning and alignment of the reinforcing structural material within the mold cavity by positioning the walls in a vertical position prior to pouring concrete.

It is a further object of this invention to provide a core form for use with an outer form which permits a casting to be easily released and removed for the mold cavity upon disassembly or removal of the outer form from the surface of the outer casting.

It is a further object of this invention to provide a casting core form for use with an outer form where the core form retracts about its entire perimeter while enabling the molding of a continuous wall without joints, gaps or breaks.

It is an advantage of this invention to increase the number of casting produced per day while decreasing the manual labor required per casting.

It is an advantage of this invention in being economical to operate.

The foregoing has outlined some of the more pertinent objects and advantages of the present invention. These objects and advantages should be construed to be merely illustrative of some of the more prominent features and applications of the invention. Many other beneficial results can be attained by applying the disclosed invention in a different manner or modifying the invention within the scope of the disclosure. Particularly, with regard to the use of the invention disclosed herein, this should not be construed as being limited to the preparation of cast steel reinforced concrete structures, but should include any cast reinforced structures. Accordingly, other objects and advantages and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The casting core and outer casting form of the present invention are defined by the appended claims with a specific embodiment shown in the attached drawings. For purposes of summarizing the invention, the invention relates to an internal retractable casting core and an outer opening casing form for casting a hollow structurally reinforced structure. The invention also relates to a method of using the casting core and the outer casting form.

The retractable core for casting a structurally reinforced concrete structure is used on a horizontal supporting slab with an outer container form having rigid walls extending vertically relative to the supporting slab and comprising a casting core positioned internal the outer form with vertically extending walls relative the supporting slab defining an within contiguous core wall. The walls of the casting core are resilient to enable retraction and extension thereof relative the rigid walls of the outer form. A means for extending and retracting the internal contiguous core wall of the casting core includes hydraulic rams, turnbuckles or the like attached to the inner side of the core walls. The internal contiguous core wall of the casting core and the walls of the outer form are spaced apart to define a mold cavity therebetween. A form base or pallet having an inner edge and an outer edge is supported by the supporting slab and is positioned within the mold cavity. The form base releasingly supports the concrete structure within the form. A means for bracing the internal contiguous core wall of the casting core in an extended position during the pouring and curing of the concrete into the mold cavity is disclosed. The means for bracing includes wood or steel bars extending between the extended opposing contiguous core walls to lock the contiguous core walls in an expanded position. The internal contiguous core wall of the casting core includes an upper and a lower periphery with the lower periphery being spaced above the supporting slab to enable expansion and retraction of the walls of the casting core relative the form base without frictional engagement with the supporting slab. The casting core is supported by the supporting slab by a pedestal secured thereto. The lower periphery of the internal contiguous core wall of the casting core is adjacent the inner edge of the form base to sealingly abut with the inner edge of the form base when the internal contiguous core wall of the casting core is extended and braced during pouring and curing of the concrete within the mold cavity. The core of the invention enables in use the retraction of the internal contiguous core wall of the casting core to provide for the placement and alignment of the structural reinforcing relative the internal contiguous core wall of the casting core and the walls of the outer form within the mold cavity prior to adding concrete into the mold cavity. The core of the invention permits extending the internal contiguous core wall to thereby sealingly abut with the inner edge of the form base and aligns the structural reinforcing relative the internal contiguous core wall of the casting core and the walls of the outer form within the mold cavity prior to the pouring and curing of the concrete within the mold cavity. The core of the invention further permits the retraction of the internal contiguous core wall of the casting core after the cast reinforced concrete structure is cured thereby enabling the cast reinforced concrete structure to be easily released from the internal contiguous core wall of the casting core thereby aiding in the removal of the cast structure from the form. Preferably, the outer form and core form are four sided and include a square and/or a rectangle where the number of core forms within the outer form may be one or more.

In a further embodiment of the present invention, the casting core is rectangular with the internal contiguous core wall further including a first, second, third and fourth wall formed of a resilient material. Generally, the first and third walls are opposite one another and are longer relative the second and fourth walls. Where the length of the first and third walls is about four feet, or less, and is greater than the second and fourth walls, the first and third walls have a thickness greater than the thickness of the second and fourth walls.

In constructing the casting core, the resilient material of the contiguous core wall is preferably steel. In relatively small rectangular castings, longest wall four feet or less. the use of varying thicknesses enhances wall thickness uniformity of each casting and among casting from the same mold and enables greater contraction of the internal contiguous core wall.

Preferably, the internal contiguous core wall further includes chamfered corners. Most preferably, the thickness of the chamfered corners is greater than the thickness of any of the vertically extending walls which comprise the internal contiguous core wall. Generally, the internal contiguous core wall is formed by welding the vertically extending walls together to form a hollow structure. If the internal contiguous core wall includes chamfered corners, the vertically extending walls are welded to the chamfered corners to form a hollow structure.

Preferably, the means for extending and retracting the internal contiguous core wall of the casting core is a hydraulic ram which is hydraulically operated.

A further embodiment of the invention includes a casting form comprising a complete outer form and core form for casting a structurally reinforced concrete structure for use on a horizontal supporting slab including an outer container form having a plurality of rigid walls extending vertically relative the supporting slab with each rigid wall having a first and a second end. The first end of each rigid wall is pivotally secured to the supporting slab, by a hinge or the like, to enable the second end of each rigid wall to be pivoted outwardly relative the first end to a position less than vertical. A means to brace each of the rigid walls of the outer form prevents pivoting of each of the braced rigid walls of the outer form during the pouring and curing of the concrete against the rigid walls. The means for bracing includes a plurality of struts with at least one strut being releasably secured to each of the rigid walls and to the supporting slab or an area proximate the supporting slab.

A first casting core is positioned within the outer form with vertically extending walls relative the supporting slab defining an internal contiguous core wall. The internal contiguous core wall of the casting core is resilient to enable retraction and extension thereof relative the rigid walls of the outer form. A means for extending and retracting the internal contiguous core wall of the casting core is disclosed. The walls of the outer form and the internal contiguous core wall of the casting core are spaced apart to define a first mold cavity therebetween.

A form base supported by the supporting slab and positioned within the mold cavity releasingly supports the cast concrete structure within the form. The form base or pallet includes an inner edge and an outer edge. When a plurality of casting cores are adjacently positioned within the outer form, the adjacent contiguous core walls of the adjacent casting cores are spaced apart to define a second mold cavity. A bridge portion of the form base is positioned within the second mold cavity and extends between adjacent casting cores and interconnects the form base.

A means for bracing the internal contiguous core wall of the casting core during the pouring and curing of the concrete in the mold cavity is disclosed.

The internal contiguous core wall of the casting core includes an upper and lower pheriphery. The lower periphery of the internal contiguous core wall is spaced above the supporting slab to enable extension and retraction of the internal contiguous core wall of the casting core relative the rigid walls of the outer form. The lower periphery of the internal contiguous core wall of the casting core is adjacent the inner edge of the form base to sealingly abut the inner edge of the form base when the internal contiguous core wall of the casting core is extended and braced during pouring and curing of the concrete within the mold cavity. Pivoting each of the rigid walls of the outer form outwardly relative the first end of the rigid wall to a position less than vertical and retracting the internal contiguous core wall of the casting core enables the placement of the structural reinforcing within the mold cavity prior to adding concrete into the mold cavity. Pivoting each of the rigid walls of the outer form to a substantially vertical position relative the supporting slab and extending the internal contiguous core wall to sealingly abut the outer edge of the form base and to align the structural reinforcing relative the internal contiguous core wall of the casting core and the rigid walls of the outer form within the mold cavity prior to the pouring and curing of the concrete within the mold cavity. Retracting the internal contiguous core wall of the casting core and pivoting each of the rigid walls of the outer form outwardly relative the first end of the rigid wall to a position less than vertical after the cast reinforced concrete structure is cured enables the cast reinforced concrete structure to be easily released and removed from the form.

Preferably, the means for bracing each of the rigid walls of the outer form when pivoted in a vertical position to prevent pivoting during the pouring and curing of the concrete within the mold cavity is a latch together with strut(s). The latch comprises a device that fastens two adjacent perpendicularly positioned rigid walls together thereby preventing movement relative the adjacent wall.

Preferably, the casting core further includes a first, second, third and fourth wall. The first and third walls are opposite one another and are longer relative the second and fourth walls. The first and third walls are formed of a resilient sheet having a thickness greater than the thickness of the second and fourth walls. Preferably, the casting core includes chamfered corners.

Most preferably, the thickness of the chamfered corners is greater than the thickness of any of the first, second, third and fourth walls to further insure consistency among the castings.

Preferably, the means for extending and retracting the internal contiguous core wall of the casting core is a hydraulic ram which is hydraulically operated. Other means includes turnbuckles which extend and retract bar(s) secured to opposing core walls.

In a further embodiment each of the rigid vertically extending walls of the outer form further include an upper portion and a lower portion. The lower portion of each of the rigid walls of the outer form is adjacent the outer edge of the form base to sealingly abut the outer edge of the form base when the rigid walls of the outer form are vertically positioned relative the supporting slab. This seals the concrete within the mold cavity relative to the lower portion of the vertically extending rigid walls of the outer form and the outer edge of the form base.

Most preferably, the casting form of the invention further includes a header positioned about the upper periphery of the casting core walls and which cooperates with the plurality of rigid walls of the casting core to provide a first funnel portion. The upper portion of each of the rigid walls of the outer form further include a second funnel portion, such that in use the first funnel portion and the second funnel portion funnel plastic or uncured concrete into the mold cavity. Preferably, the form base includes an outer step for casting an inner ring on the bottom of the casting. The header includes an inner step for enabling the casting of an outer ring or bell on the top of the casting.

In a further embodiment of the invention the form includes a plurality of casting cores positioned within the outer form. The plurality of casting cores are spaced apart to define a continuous mold cavity comprising a first mold cavity between the core wall and the walls of the outer form and a second mold cavity between adjacent core walls. The phrase "mold cavity" includes the space between the spaced apart outer form walls and the adjacent contiguous core walls and further includes the space between spaced apart adjacent contiguous core walls where more that one casting core is within the outer form.

In a preferred embodiment of the invention the casting form includes a first and second casting core positioned within the outer form. The first and second casting cores are spaced apart to further define a second mold cavity therebetween. The second mold cavity is in continuous contact with the first mold cavity. The first mold cavity is defined by the space between the walls of the outer form and the adjacent contiguous core wall.

The invention may also be incorporated into a process of casting a reinforced concrete structure on a horizontal supporting slab by providing an outer container form having a plurality of rigid walls extending vertically relative the supporting slab. Each rigid wall includes a first and a second end with the first end of each rigid wall being pivotally secured to the supporting slab. A means is used to brace each rigid wall of the plurality of rigid walls of the outer form. A first casting core is positioned internal the outer form. The first casting core includes vertically extending walls relative the supporting slab defining an internal contiguous core wall. The internal contiguous core wall of the first casting core is resilient to enable retraction and extension thereof relative the rigid walls of the outer form. A means is set forth for extending and retracting the internal contiguous core wall of the first casting core. The walls of the outer form and of the internal contiguous core wall of the first casting core are spaced apart to define a first mold cavity therebetween. A form base supported by the supporting slab and positioned within the first mold cavity releasingly supports the cast concrete structure being cast within the first mold cavity. The form base includes an inner and outer edge. A means is set forth for bracing the internal contiguous core wall of the first casting core during the pouring and curing of the concrete in the first mold cavity.

A casting operation for casting a reinforced concrete structure is conducted by pivoting each rigid wall of the plurality of rigid walls of the outer form outwardly relative the first end of each rigid wall to a position less than vertical. The internal contiguous core wall of the first casting core is retracted to a first position to enable the placement of the structural reinforcing material, such as a steel cage or the like, within the first mold cavity prior to adding concrete into the first mold cavity. The structural reinforcing material is then positioned within the first mold cavity. Each rigid wall of the plurality of rigid walls of the outer form is pivoted to a substantially vertical position relative the supporting slab and the internal contiguous core wall is extended to the second position to sealingly abut the outer and inner edge of the form base respectively and to align the structural reinforcing material relative the internal contiguous core wall of the first casing core and each rigid wall of the outer form within the first mold cavity. Each rigid wall of the plurality of rigid walls of the outer form and the internal contiguous core wall of the first casing core are braced to prevent pivoting of the outer form walls and expanding of the internal contiguous core wall during the pouring and curing of the concrete positioned against each rigid wall of the plurality of rigid walls of the outer form and wall of the internal contiguous core. The concrete is then poured within the first mold cavity to completely cover the reinforcing material and to fill the first mold cavity. The poured concrete is allowed to cure. The internal contiguous core wall of the first casing is then retracted to a first position and each rigid wall of said plurality of rigid walls of the outer form is pivoted outwardly relative the first end of each rigid wall to a position less than vertical to enable the cured cast reinforced concrete structure to be easily released and removed from the form.

The casting process further includes a second casting core adjacently positioned to the first casting core internal the outer container form with a second mold cavity defined by oppositely positioned adjacent contiguous core walls of the first and second casting cores. The second mold cavity is in continuous contact with the first mold cavity. The form base includes a bridged portion to support the dividing wall extending between the oppositely positioned adjacent contiguous core walls of the first and second casting cores and is positioned within the second mold cavity. A casting operation for casting a reinforced concrete structure is conducted by extending and retracting the internal contiguous core wall of the second casting core in the same sequence and manner as the first casting core including positioning the structural reinforcing material within the first and second mold cavity and additionally pouring concrete within the second mold cavity.

The casting process further includes a plurality of casting cores with each casting core adjacently positioned relative to another casting core within the outer container form. A second mold cavity defined by each oppositely positioned adjacent contiguous core walls of the adjacent casting cores is in continuous contact with the first mold cavity. The form base including a bridged portion to support each dividing wall of the casting extending between each oppositely positioned adjacent contiguous core walls of the plurality of casting cores. The bridged portion of the form base is positioned within each second mold cavity. A casting operation for casting a reinforced concrete structure includes extending and retracting each internal contiguous core wall of the plurality of casting core in the same sequence and manner as the first casting core including positioning the structural reinforcing material within the first and second mold cavity and additionally pouring concrete within the second mold cavity. The casting produced by the apparatus of the invention include box culverts, and the like.

The foregoing has outlined rather broadly the more pertinent and important features of the present invention in order that the detailed description of the invention that follows may be better understood so that the present contribution to the art can be more fully appreciated. Additionally, features of the invention will be described hereinafter which form the object of the claims of the invention and it should be appreciated by those skilled in the art that the conception of the specific embodiment disclosed may be readily utilized as a basis for modifying and designing other devices for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a better understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
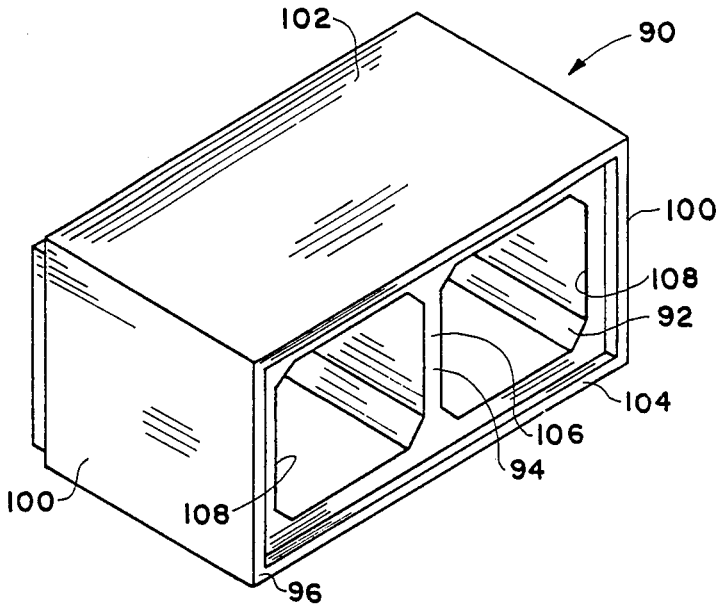
FIG. 1 is an isometric view of a casting cast utilizing the apparatus of the invention.

FIG. 1 is an isometric view of a box culvert cast utilizing the apparatus of the invention. FIG. 1 illustrates the casting 90 with the top 102, bottom 104, first side 100, second side 101 and passageway 108 dividing wall 106 of a uniform thickness defined by the dimensions of the mold cavity. The dimensions of the casting 90 and other castings from the same casting form vary little if at all. The casting form consistently casts a concrete casting of a predetermined wall thickness and shape while maintaining a high tolerance between the castings.

Figure 2:
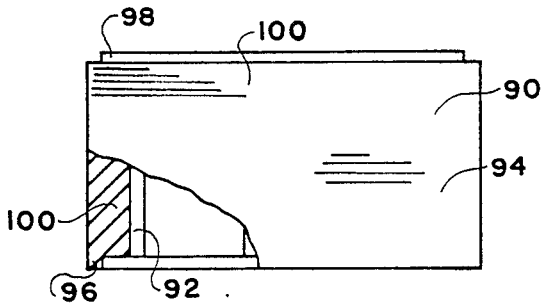
FIG. 2 is a partial sectional top view of FIG. 1.

FIG. 2 is a partial sectional top view of FIG. 1 illustrating the outer ring or bell 96 and the inner ring 98 of casting 90.

Figure 3:
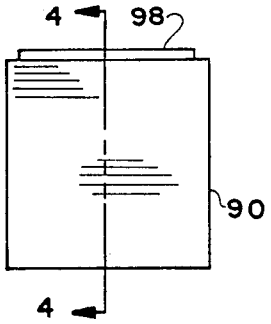
FIG. 3 is a side view of FIG. 2.

FIG. 3 is a side view of the casting set forth in FIG. 2.

Figure 4:
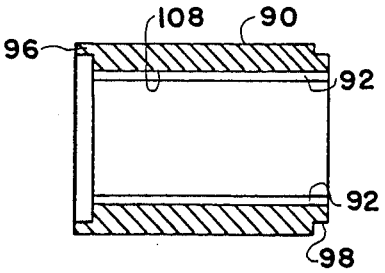
FIG. 4 is a sectional view taken along line 4—4 of FIG. 3.

FIG. 4 is a sectional view taken along line 4—4 of FIG. 3 illustrating passage 108 extending through the casting 90.

Figure 5:
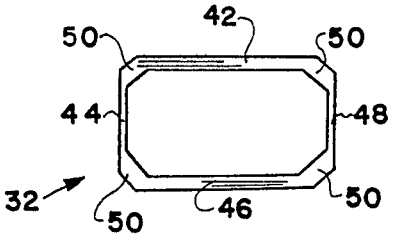
FIG. 5 is an enlarged top view of the casting core.

FIG. 5 is an enlarged top view of the rectangular casting core 32 illustrating the relative thickness of the contiguous core wall 36. The contiguous core wall 36 includes a first 42, second 44, third 46 and fourth 48 wall. The first 42 and third walls 46 are opposite one another and are longer relative the second 44 and fourth walls 48. The second 44 and fourth 48 walls being formed to a first thickness. The first 42 and third 46 walls have a thickness greater than the thickness of the second 44 and fourth 46 walls. The thickness of the chamfered corners 50 is greater than the thickness of any of the first 42, second 44, third 46 and fourth 48 walls. The variance of thickness within the contiguous core wall 36 enables uniform expansion and retraction of the wall 36 along its vertical dimension while retaining core wall rigidity resulting in extremely uniform castings. This embodiment is especially advantageous where a rectangle is being cast having a longest wall of about four feet or less.

Figure 6:
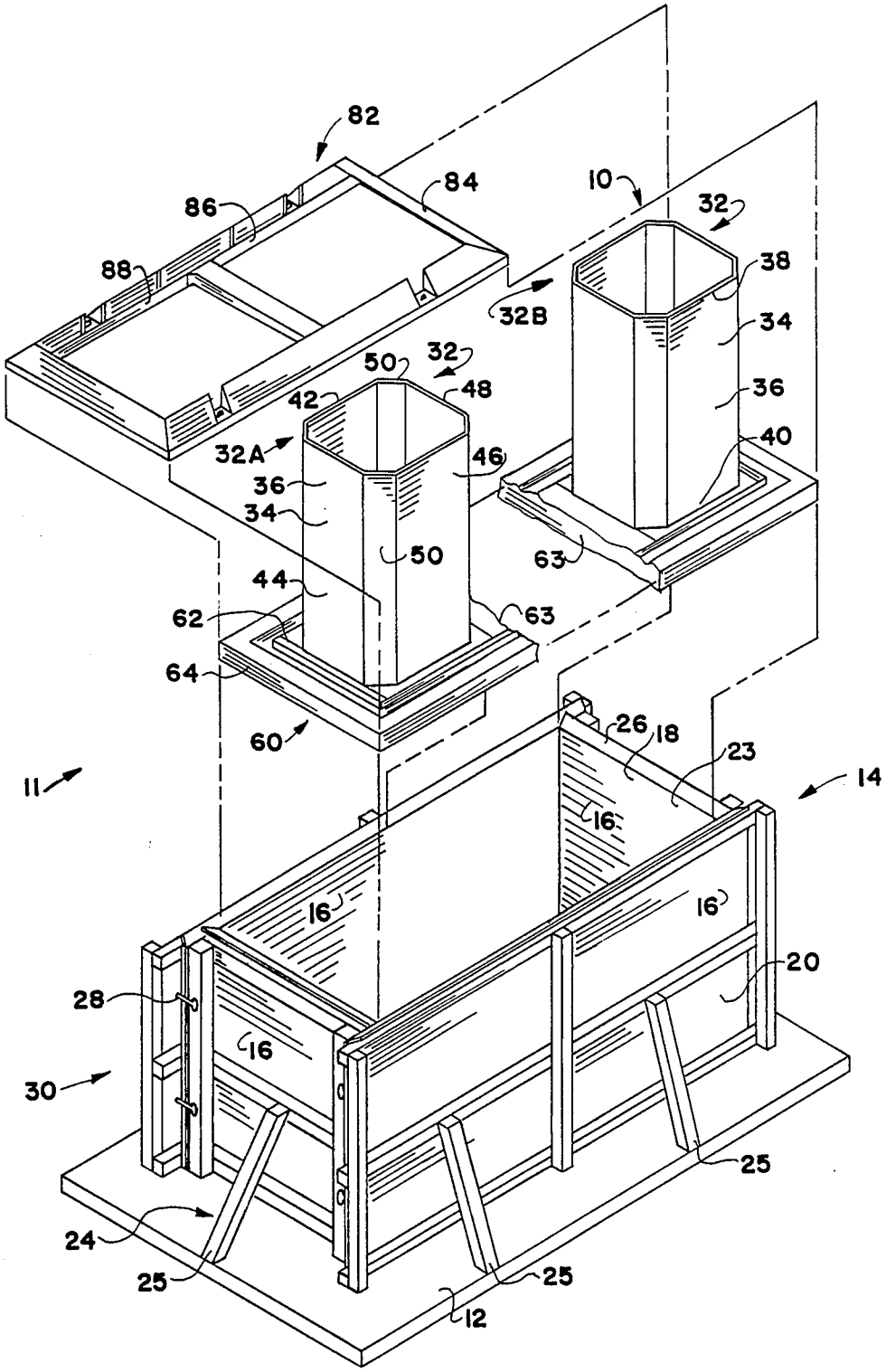
FIG. 6 is an exploded view of the apparatus of the invention.
Figure 8:
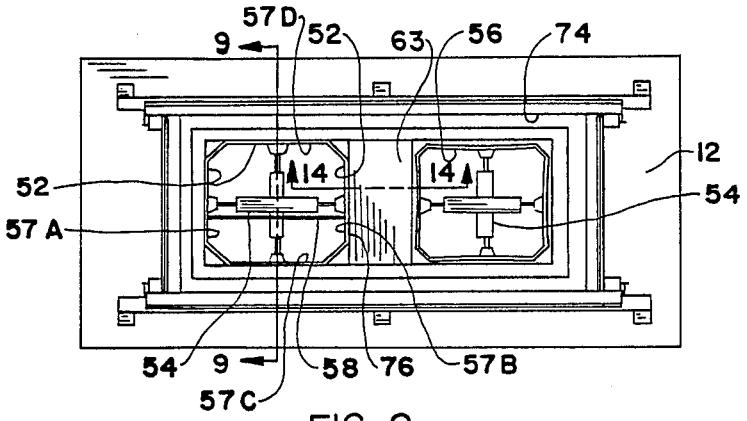
FIG. 8 is a top view of FIG. 7.
Figure 11:
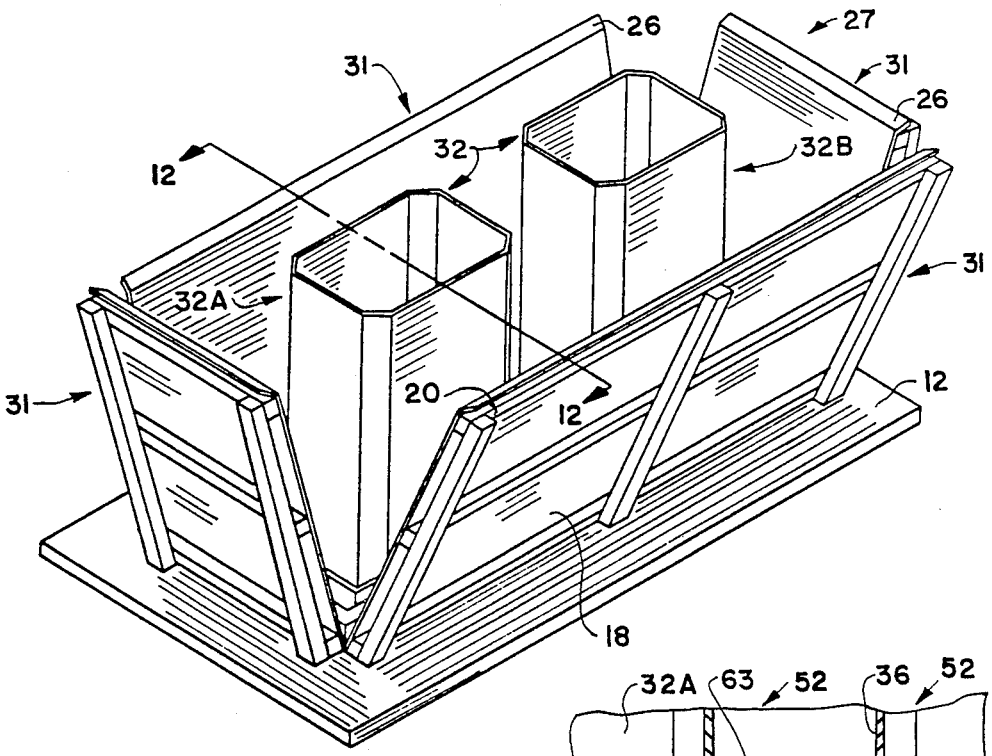
FIG. 11 is an isometric view of the apparatus of the invention at FIG. 6 in an open position.
Figure 12:
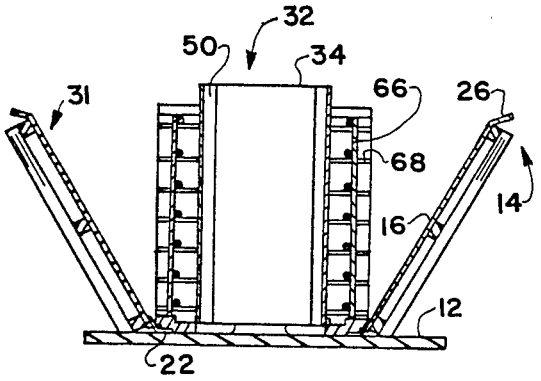
FIG. 12 is a sectional view taken along line 12—12 of FIG. 11 with the addition of steel mesh and spacers into the mold cavity.

FIG. 6 is an exploded view of the apparatus of the invention 11 illustrating the outer form 14 and casting core 10 of the invention. The generally rectangular outer casting form 14 includes a plurality of vertically extending rigid walls 15 extending from the supporting slab 12. Each of the rigid walls 16 of the outer form 14 are of sufficient strength to support weight of concrete, or the like, when the concrete, or the like, is positioned within the mold cavity 74 without deforming. The walls 16 each include a first end 18 and a second end 20. The first end 18 of each wall 16 is pivotally secured to the supporting slab 12 by a hinge 22 as shown at FIG. 12, to enable the second end of the rigid wall 20 to be pivoted outwardly relative the first end 18 to a position less than vertical 31, as shown at FIG. 11. A means to brace 24 the rigid walls 16 of the outer form 14 prevent pivoting because of the force exerted by the concrete during the pouring and curing of the concrete against the rigid walls 16 includes a plurality of struts 25. As illustrated at FIG. 6 two casting cores 32A, 32B are adjacently positioned within the outer form 14. For sake of brevity, a discussion of one casting core describes the other. A generally rectangular casting core 32 is positioned internal the outer form 14 with vertically extending walls 34 relative the supporting slab 12 defining a contiguous core wall 36. The internal contiguous core wall 36 of the casting core 32 being resilient to enable retraction and extension thereof relative the rigid walls 16 of the outer form 14 to a retracted position 56 and to an extended position 52 as shown at FIG. 8. A means for extending and retracting 54 the internal contiguous core wall 36 of the casting core 32 includes a hydraulic ram 55 powered by a hydraulic pump (not shown) in a manner known to those skilled in the art as shown at FIG. 8. The rigid walls of the outer form 16 and of the internal contiguous core 36 of the casting core 32 are spaced apart to define a mold cavity 74 therebetween as shown at FIG. 8. A form base 60 supported by the supporting slab 12 is positioned within the mold cavity 74 to releasingly support the cast concrete structure 90 within the form 11. The form base 60 includes an inner edge 62 and an outer edge 64. A means for bracing 58 the internal contiguous cage wall 36 of the casting core 32 during the pouring and curing of the concrete in the mold cavity 74 includes steel or wooden bars wedging opposing core walls 57A–57B and 57C–57D of casting core 32 in an extended position 52 as shown in FIG. 8.

Figure 10:
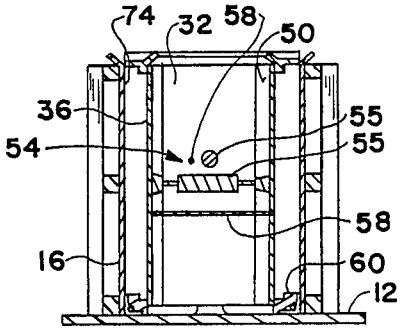
FIG. 10 is the same view as FIG. 9 with the addition of the header positioned at the upper periphery of the core wall.

A header 82 is positioned about the upper periphery 38 of the vertically extending casting core walls 34. The header 82 cooperates with the vertically extending rigid walls 34 of the casting core 32 to provide a first funnel portion 84. The upper portion 23 of each of the rigid walls 16 of the outer form 14 further includes a second funnel portion 26. The first funnel portion 84 and the second funnel portion 26 funnel concrete into the mold cavity 74. The header 82 also includes an inner rib member 86 positioned about the inner periphery 88 of the header 82 to enable the header to cast an outer ring 96 during the casting process as best illustrated at FIG. 10. The header 82 optionally includes a bridge member 81 which rigidly interconnects the first end 83 and second end 85. The bridge member 81 further includes an opening 87 formed therein to enable the passage therethrough of concrete into the form for dividing wall 106.

The internal contiguous core wall 36 of the casting core 32 includes an upper periphery 38 and a lower periphery 40. The lower periphery 40 of the internal contiguous core wall 36 is spaced above the supporting slab 12 to enable expansion and retraction of the internal contiguous core wall 36 of the casting core 32 relative the rigid walls 16 of the outer form 14.

Figure 13:
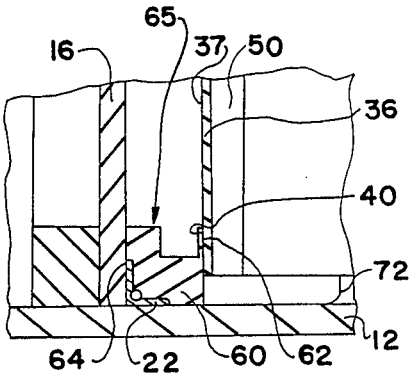
FIG. 13 is an enlarged partial view taken from FIG. 9.

The lower periphery 40 of the internal contiguous core wall 36 of the casting core 32 is adjacent the inner edge 62 of the form base 60 to sealingly abut the inner edge 62 of the form base 60 when the internal contiguous core wall 36 of the casting core 32 is extended and braced at an extended position 52 during the pouring and curing of the concrete within the mold cavity 74 as illustrated at FIG. 13.

Figure 7:
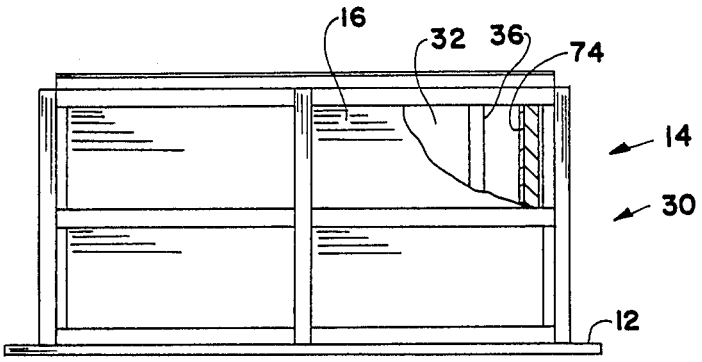
FIG. 7 is a side view of the apparatus of the invention without the header and a partial sectional view.

FIG. 7 is a side view of the apparatus of the invention 11 on supporting slab 12 absent the header 82. FIG. 7 includes a partial sectional view illustrating the vertically extending walls 16 of the outer casting form 14 set in a casting position 30. The mold cavity 74 and the casting core 32 are positioned within the walls 16 of the outer form 14.

FIG. 8 is a top view of FIG. 7 illustrating the walls of the casting core 32 in an extended position 52 and further illustrating the walls of the adjacent casting core in a retracted position 56. The casting cores 32A and 32B are spaced apart to define a second mold cavity 76 which is in continuous contact with the mold cavity 74. Mold cavity 74 is defined by the space between the walls 16 of the outer form 14 and the adjacent contiguous core wall 36.

Figure 9:
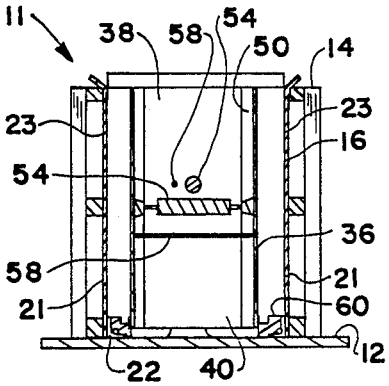
FIG. 9 is a sectional view taken along line 9—9 of FIG. 8.

FIG. 9 is a sectional view taken along line 9—9 of FIG. 8 illustrating the hydraulic ram 54 for expanding and retracting the opposing contiguous core wall 57A–57B and 57C–57D of casting core 32 at FIG. 8. A bracing bar 58 braces the contiguous core wall 36 in an extended position 52. The rigid walls 16 of the outer form 14 further include a lower portion 21 and an upper portion 23. The lower portion 21 of the rigid walls 16 of the outer form 14 is adjacent the outer edge 64 of the form base 60 to sealingly abut against the outer edge 64 of the form base 60 when the rigid walls 16 of the outer form 14 are vertically positioned 30 relative the supporting slab 12 thereby sealing the concrete internal the mold cavity 74 relative the lower portion 21 of the rigid walls 16 of the outer form 14 and the outer edge 64 of the form base 60, as shown at FIG. 13.

FIG. 10 is the same view as FIG. 9 with the addition of the header 82 positioned at the upper periphery 38 of the core wall 36.

FIG. 11 is an isometric view of the apparatus of the invention at FIG. 6 in an open position 27. The open position 27 defines the walls 16 of the outer casting form 14 being less than vertical 31 and with the contiguous core wall 36 of casting cores 32A and 32B being in a retracted position 56. The open position 27 enables preparation of the form for another casting and insertion of the steel mesh cage 66 (FIG. 12). The apparatus of the invention 11 enables the steel mesh cage to be fabricated into the shape of the mold cavity needed for the casting. The cage is then inserted into the mold cavity 74 by a crane.

FIG. 12 is a sectional view taken along line 12—12 of FIG. 11 with the addition of mesh 66. FIG. 12 illustrates the positioning of the steel mesh 66 and spacers 68 into the mold cavity 74.

FIG. 13 is an enlarged partial view taken from FIG. 10. The figure illustrates the form base 60 with the inner edge 62 of the form base 60 sealingly abutting against the lower periphery 40 of the contiguous core wall 36 of the casting core 32 when the contiguous core wall 36 is expanded to an extended position 52. The outer edge 64 of the form base 60 sealingly abuts against the lower portion 21 of the rigid walls 16 of the outer form 14 when the walls of the outer form 16 are pivoted to a substantially vertical position 30 relative the supporting slab 12. Also illustrated is a portion of pedestal 72 which supports the casting core 32 above the supporting slab 12.

Figure 14:
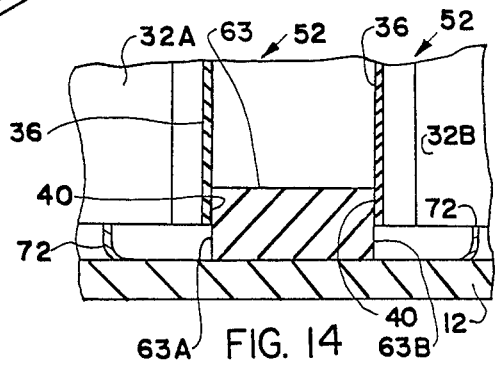
FIG. 14 is a partial sectional view take along line 14—14 of FIG. 8

FIG. 14 illustrates a bridge portion 63 of form base 60 having a first outer surface 63A and a second outer surface 63B. The bridge portion 63 is utilized when a plurality of casting cores 32A, 32B are adjacently positioned within the outer form 14. The adjacent contiguous core walls 36A and 36B of adjacent casting cores 32A and 32B are spaced apart to define a second mold cavity 76. The bridge portion 63 of the form base 60 is positioned within the second mold cavity 76 and extends between adjacent casting cores 32A and 32B and interconnects the form base 60. When the contiguous core wall 36 of the casting core 32 is in an expanded position 52, the lower periphery 40 of contiguous core wall 36 of casting core 32A and the lower periphery 40 of contiguous core wall 36 of casting core 32B sealingly abut the first outer surface 63A and the second outer surface 63B of form base 60, respectively. The structural reinforcing material 66 is positioned within the second mold cavity 76 when the adjacent core walls are in a retracted position 56. The structural reinforcing material 66 is aligned relative the adjacent core walls of casting core 32A and 32B, respectively, when the adjacent core walls of casting core 32A and 32B are placed in an extended position 52.

The apparatus of the invention enables the pivoting the rigid walls 16 of the outer form 14 outwardly relative the first end 18 of the rigid wall 16 to a position less than vertical 31 and retracting the internal contiguous core wall 36 of the casting core 32 to a retracted position 56 to enable the placement of the structural reinforcing 66 within the mold cavity 74 prior to adding concrete into the mold cavity.

The rigid walls 16 of the outer form 14 are positioned to a substantially vertical position 30 relative the supporting slab 12. The internal contiguous core wall 36 is extended to an extended position 52 to sealingly abut the inner edge 62 of the form base 60 with the lower periphery 40 of the casting core 32. The movements of the outer walls 16 and the core walls 32 aligns the structural reinforcing material 66 relative the internal contiguous core wall 36 of the casting core 32 and the rigid walls 16 of the outer form 14 within the mold cavity 74 prior to the pouring and curing of the concrete within the mold cavity 74.

The internal contiguous core wall 36 of the casting core 32 is collapsed to a retracted position 56 and the rigid walls of the outer form 16 are pivoted outwardly relative the first end 18 of the rigid wall 16 to a position less than vertical 31 after the cast reinforced concrete structure 90 is cured to enable the cast reinforced concrete structure 90 to be easily released and removed from the form 11.

As described above, where a plurality of casting cores are positioned within an outer form 14, a second mold cavity 76 is defined by the adjacent core walls of adjacently positioned casting cores 32A, 32B. Accordingly, when the contiguous core wall of each adjacent core is retracted, placement of structural reinforcing material can be easily positioned therein prior to the pouring and curing of the concrete. Also, when the contiguous core wall of each adjacent core is extended, the structural reinforcing material is aligned by the extending walls engaging the spacers thereby positioning the reinforcing material. Further, after the casting has cured, release and removal of the casting is aided by retracting the each contiguous core wall of the adjacent casting cores 32A and 32B.

The shape of the outer form 14 and the internal casting core 32 is preferably four sided which includes generally square and generally rectangular outer forms and casting cores with a correspondingly similar base form. The generally rectangular and generally square shapes display a maximum advantage in the use of the multi-thickness casting core. As the shape of the casting core approaches a square, the thickness of the walls can be equal or substantially so. Also, in casting cores having a wall length greater than about four feet, the thickness of the contiguous walls may be equal or substantially so. In casting a substantially rectangular casting with the longest wall size about four feet or less, the thickness of the shorter walls is less than the longer walls. This insures maximum pull back of the contiguous walls while maintaining core uniformity between castings. In order to provide the most uniform casting, it is preferred that the chamfered corners have a thickness greater than the thickness of any of the sides of the contiguous core wall. That is, if the chamfered corners are not of a sufficient thickness, the contiguous wall will neither readily expand and retract as a unit nor readily retain required core wall rigidity thereby resulting in poorly shaped and misshaped castings. It is preferred that the casting core and the inner edge of the form base are of the same shape and that the outer form and the outer edge of the form base are of the same shape to attain the objects and advantages of the invention, namely the sealingly abutment of the outer walls and contiguous core walls adjacent the base form when positioned in a casting position.

To illustrate the process of using the apparatus of the invention a 4 foot×5 foot double box culvert (FIG. 1) was cast. The process included providing the generally rectangular outer form together with two casting cores on a supporting slab as described above. A description of the operation of one casting core describes the operation of the other. The casting operation comprised pivoting the rigid walls of the outer form outwardly relative the first end of the rigid wall to a position less than vertical and retracting the internal contiguous core wall of the casting core to a first position. The thickness of the contiguous core walls was ¼ inch for the walls and ⅜ inch for the chamfered corners. This position enabled a releasing agent, such as oil, to be applied to the walls of the mold cavity. The structural reinforcing material, about 80 pounds of rebar and 600 pounds of steel wire mesh with spacers was positioned within the mold cavity prior to adding concrete into the mold cavity. The spacers extend between the outer form wall and the core wall when the walls in a closed or casting position. Eight lifting loops were positioned in the mold cavity. The rigid walls of the outer form were pivoted to a substantially vertical position relative the supporting slab and the internal contiguous core wall was extended to the second position. At this position the outer walls and the core walls sealingly abutted the form base and aligned the structural reinforcing material relative the internal contiguous core wall of the casting core and the rigid walls of the outer form within the mold cavity by engaging the spacers of the steel mesh. The rigid walls of the outer form and the internal contiguous core wall of the casting core were braced to prevent pivoting of the outer form walls and expanding of the internal contiguous core wall during the pouring and curing of the concrete positioned against the rigid walls of the outer form and wall of the internal contiguous core. The header was positioned at the upper periphery of the casting core. About 5.4 yards of concrete was poured directly into the mold cavity from a concrete truck which was positioned above the casting form on a man-made elevated road adjacent to the casting form. A concrete vibrator was used to insure that any voids were filled with concrete. The casting form was covered and steamed to increase the cure rate of the concrete in a manner well known in the art. After about 6–7 hours the concrete was cured. The header was removed from the top of the form. The internal contiguous core wall of the casting core was retracted to a first position and the rigid walls of the outer form were pivoted outwardly relative the first end of the rigid wall to a position less than vertical. A crane with a lifting platform having 8 cables which were attached to the lifting loops of the casting was used to lift and remove the casting from the form. The form was then prepared for another casting. Up to about 2–3 casting per day is easily attainable when using the form of the invention.

The present disclosure includes that contained in the appended claims as well as that of the foregoing description. Although the invention has been described in its preferred form with a certain degree of particularity, it is understood that the present invention of the preferred form has been made only by way of example, and that numerous changes in the details of construction and the combination and arrangement of parts may be resorted to without departing from the spirot and scope of the invention.

What is claimed is:

1. A form for casting a structurally reinforced concrete structure for use on a horizontal supporting slab comprising:

an outer container form having a plurality of rigid walls with each rigid wall extending vertically relative to the supporting slab;

each rigid wall of said plurality of rigid walls having a first and a second end;

said first end of each rigid wall of said plurality of rigid walls being pivotally secured to the supporting slab to enable said second end of each rigid wall to be pivoted outwardly relative to said first end to a position less than vertical;

means to brace each rigid wall of said plurality of rigid walls of said outer form to prevent pivoting during the pouring and curing of the concrete against said rigid walls;

a casting core positioned within said outer container form and having vertically extending walls relative to the supporting slab defining an internal contiguous core wall;

said internal contiguous core wall of said casting core being resilient to enable retraction and extension thereof relative to said plurality of rigid walls of said outer form;

said casting core further includes chamfered corners having a thickness greater than the thickness of any said vertically extending walls comprising the internal contiguous core wall;

means for retracting said internal contiguous core wall of said casting core such that said internal contiguous core wall of said casting core is retracted to a first position and said pivoting of each rigid wall of plurality of said rigid walls of said outer form outwardly relative to said first end of said rigid wall to a position less than vertical after the cast reinforced concrete structure is cured enables the cast reinforced concrete structure to be easily released and removed from the form and prior to adding concrete enables the placement of the structural reinforcing within said mold cavity;

each rigid wall of said plurality of said rigid walls of said outer form and said internal contiguous core wall of said casting core being spaced apart to define a mold cavity therebetween;

a form base supported by the supporting slab and positioned within said mold cavity to releasingly support the cast concrete structure within the form;

said form base having an inner and outer edge;

said internal contiguous core wall of said casting core includes an upper and lower periphery;

said lower periphery of said internal contiguous core wall being spaced above the supporting slab to enable extension and retraction of said internal contiguous core wall of said casting core relative to each rigid wall of said plurality of rigid walls of said outer form;

said lower periphery of said internal contiguous core wall of said casting core being adjacent said inner edge of said form base to sealingly abut said inner edge of said form base when said internal contiguous core wall of said casting core is extended and braced at a second position during pouring and curing of the concrete within said mold cavity;

means for extending said internal contiguous core wall of said casting core such that said pivoting of each rigid wall of said plurality of rigid walls of said outer form to a substantially vertical position relative to the supporting slab and extending said internal contiguous core wall to said second position sealingly abuts said form base and aligns the structural reinforcing relative to said internal contiguous core wall of said casting core and each rigid wall of said plurality of rigid walls of said outer form within said mold cavity prior to the pouring and curing of the concrete within said mold cavity;

means for bracing said internal contiguous core wall of said casting core during the pouring and curing of the concrete in said mold cavity.

2. The form of claim 1 wherein said means for bracing each rigid wall of said plurality of rigid walls of said outer form when pivoted in a vertical position to prevent pivoting during the pouring and curing of the concrete within said mold cavity is a latch.

3. The form of claim 1 wherein said contiguous core wall of said casting core further includes a first, second, third and fourth wall;

wherein said first and third walls are opposite one another and are longer relative to said second and fourth walls; and said second and fourth walls being formed of a resilient sheet and include a first thickness.

4. The contiguous core wall of claim 3 wherein said first and third walls are formed of a resilient sheet having a thickness greater than the thickness of said second and fourth walls.

5. The form of claim 1 wherein said outer form and said internal casting core are of a generally rectangular configuration.

6. The form of claim 1 wherein said outer form and said internal casting core are of a generally square configuration.

7. The casting core of claim 1 wherein means for extending and retracting said internal contiguous core wall of said casting core is a hydraulically operated ram.

8. The form of claim 1 wherein each rigid wall of said plurality of rigid walls of said outer form further include an upper portion and a lower portion.

9. The form of claim 8 wherein said lower portion of each rigid wall of said plurality of rigid walls of said outer form is adjacent said outer edge of said form base whereby when each rigid wall of said plurality of rigid walls of said outer form are pivoted vertically relative to the supporting slab said lower portion of each rigid wall of said plurality of rigid walls of said outer form abut said outer edge of said form base to seal the concrete within said mold cavity relative to said lower portion of each rigid wall of said plurality of rigid walls of said outer form and said form base.

10. The form of claim 8 further including a header positioned about said upper periphery of said casting core walls and which cooperates with said vertical walls of said casting core to provide a first funnel portion; and said upper portion of each rigid wall of said plurality of rigid walls of said outer form further include a second funnel portion, whereby in use said first funnel portion and said second funnel portion funnel concrete into said mold cavity.

11. The form of claim 1 wherein said form base includes an outer step for casting an inner ring.

12. The form of claim 1 further includes a first and second casting core adjacently positioned within said outer form and being spaced apart to further define a second mold cavity therebetween with said second mold cavity being in continuous contact with said first mold cavity;

said form base including a bridge portion being positioned within said second mold cavity; and said form base being supported by the supporting slab and positioned within said first and second mold cavity to releasingly support the concrete structure within the form.

13. The form set forth in claim 1 further including a plurality of casting cores adjacently positioned internal said outer container form;

each casting core of said plurality of casting cores having vertically extending walls relative to the supporting slab to define an internal contiguous core wall;

said internal contiguous core wall of each of said casting cores and said plurality of rigid walls of said outer form being spaced apart to define a first mold cavity therebetween;

a second mold cavity in continuous contact with said first mold cavity defined by oppositely positioned adjacent contiguous core walls of said adjacent casting cores being spaced apart relative to one another; and said form base including a bridge portion extending between said oppositely positioned adjacent contiguous core walls of said adjacent casting cores and being positioned within said second mold cavity;

said form base being supported by the supporting slab and positioned within said first and said second mold cavity to releasingly support the concrete structure within the form.

14. A retractable core for casting a structurally reinforced concrete structure for use on a horizontal supporting slab with an outer container form having rigid walls extending vertically relative to the supporting slab, comprising:

a casting core positioned within the outer form and having vertically extending walls relative to the supporting slab defining an internal contiguous core wall;

said walls of said casting core being resilient to enable retraction and extension thereof relative to the rigid walls of the outer form;

said casting core further includes chamfered corners having a thickness greater than the thickness of any said vertically extending walls comprising the internal contiguous core wall;

means for extending and retracting said internal contiguous core wall of said casting core;

said internal contiguous core wall of said casting core and the walls of the outer form being spaced apart to define a mold cavity therebetween;

a form base supported by the supporting slab and positioned within said mold cavity to releasingly support the concrete structure within the form;

said form base having an inner and outer edge;

means for bracing said internal contiguous core wall of said casting core in an extended position during the pouring and curing of the concrete into said mold cavity;

said internal contiguous core wall of said casting core includes an upper and lower periphery;

said lower periphery of said internal contiguous core wall being spaced above the supporting slab to enable expansion and retraction of said walls of said casting core relative to said form base;

said lower periphery of said internal contiguous core wall of said casting core being adjacent said inner edge of said form base to sealingly abut said inner edge of said form base when said internal contiguous core wall of said casting core is extended and braced during pouring and curing of the concrete within said mold cavity;

whereby retracting in use said internal contiguous core wall of said casting core to a first position enables the placement and alignment of the structural reinforcing relative to said internal contiguous core wall of said casting core and the walls of the outer form within said mold cavity prior to adding concrete into said mold cavity;

whereby extending in use said internal contiguous core wall of said casting core to a second position sealingly abuts said form base and aligns the structural reinforcing relative to said internal contiguous core wall of said casting core and the walls of the outer form within said mold cavity prior to the pouring and curing of the concrete within said mold cavity; and whereby reracting in use said internal contiguous core wall of said casting core to a first position after the cast reinforced concrete structure is cured enables the cast reinforced concrete structure to be easily released from said internal contiguous core wall of said casting core thereby aiding in the removal of the cast structure from the form.

15. The casting core of claim 14 wherein said means for extending and retracting said internal contiguous core wall of said casting core is a hydraulically operated ram.

16. A form for casting a structurally reinforced concrete structure for use on a horizontal supporting slab comprising:

an outer container form having a plurality of rigid walls with each rigid wall extending vertically relative to the supporting slab;

each rigid wall of said plurality of rigid walls having a first and a second end;

said first end of each rigid wall of said plurality of rigid walls being pivotally secured to the supporting slab to enable said second end of each rigid wall of said plurality of rigid walls to be pivoted outwardly relative to said first end to a position less than vertical;

means to brace each rigid wall of said plurality of rigid walls of said outer form to prevent pivoting during the pouring and curing of the concrete against said plurality of rigid walls;

a plurality of casting cores adjacently positioned within said outer container form and each casting core of said plurality of casting cores having vertically extending walls relative to the supporting slab defining an internal contiguous core wall;

each said internal contiguous core wall of said plurality of casting cores being positioned proximate said walls of said outer form and being spaced apart to define a first mold cavity therebetween;

said internal contiguous core wall of each of said plurality of casting cores being resilient to enable retraction and extension thereof relative to said rigid walls of said outer form;

each said casting core of said plurality of casting cores further includes chamfered corners having a thickness greater than the thickness of any said vertically extending walls comprising each said internal contiguous core wall;

means for extending and retracting each said internal contiguous core wall of said plurality of casting cores;

a second mold cavity in continuous contact with said first mold cavity defined by oppositely positioned adjacent contiguous core walls of of adjacent casting cores being spaced apart relative to one another;

a form base being supported by the supporting slab and positioned within said first mold cavity to releasingly support the concrete structure within said first mold cavity;

said form base including a bridge portion extending between said adjacent casting cores and being positioned within said second mold cavity to releasingly support the concrete structure within said second mold cavity;

said form base having an inner and an outer edge and said bridge portion of said form base having a first and a second outer surface;

means for bracing each said internal contiguous core wall of said plurality of casting cores during the pouring and curing of the concrete in said first and second mold cavity;

whereby in use pivoting each rigid wall of said plurality of rigid walls of said outer form outwardly relative to said first end of each rigid wall to a position less than vertical and retracting each said internal contiguous core wall of said plurality of casting cores to a first position enables the placement of the structural reinforcing within said first and second mold cavities prior to adding concrete into said first and second mold cavities;

each said internal contiguous core wall of said plurality of casting cores includes an upper and lower periphery;

each said lower periphery of each said internal contiguous core wall of said plurality of casting cores being spaced above the supporting slab to enable expansion and retraction of each of said internal contiguous core wall of said plurality of casting cores relative to each rigid wall of said plurality of rigid walls of said outer form;

each said lower periphery of each said internal contiguous core wall of said plurality of casting cores being adjacent said inner edge of said form base and adjacent said first and second outer surface of said bridge portion of said form base to sealingly abut said inner edge of said form base and said first and second outer surface of said bridge portion of said form base when each said internal contiguous core wall of said casting core is expanded and braced to a second position during pouring and curing of the concrete within said first and second mold cavities;

whereby pivoting in use each rigid wall of said plurality of rigid walls of said outer form to a substantially vertical position relative to the supporting slab and extending each said internal contiguous core wall of said plurality of casting cores to said second position sealingly abuts said form base and said bridge portion of said form base and aligns the structural reinforcing relative to each said internal contiguous core wall of said plurality of casting cores and said rigid walls of said outer form and between said adjacent contiguous core walls within said first and second mold cavities prior to the pouring and curing of the concrete within said first and second mold cavities; and whereby retracting in use each said internal contiguous core wall of said plurality of casting cores to a first position and pivoting said rigid walls of said outer form outwardly relative to said first end of each said rigid wall to a position less than vertical after the cast reinforced concrete structure is cured enables the cast reinforced concrete structure to be easily released and removed from the form.

17. A form for casting a structurally reinforced concrete structure for use on a horizontal supporting slab comprising:

an outer container form having a first, second, third and fourth rigid wall with each rigid wall extending vertically relative to the supporting slab;

each rigid wall of said first, second, third and fourth rigid walls having a first and a second end;

said first end of each rigid wall of said first, second, third and fourth rigid walls being pivotally secured to the supporting slab to enable said second end of each rigid wall to be pivoted outwardly relative to said first end to a position less than vertical;

means to brace each rigid wall of said first, second, third and fourth rigid walls of said outer form to prevent pivoting during the pouring and curing of the concrete against each rigid wall of said first, second, third and fourth rigid walls;

a casting core positioned within said outer form and having vertically extending walls relative to the supporting slab defining an internal contiguous core wall;

said internal contiguous core wall of said casting core being resilient to enable retraction and extension thereof relative to said rigid walls of said outer form;

said casting core further includes chamfered corners having a thickness greater than the thickness of any said vertically extending walls comprising the internal contiguous core wall;

means for extending and retracting said internal contiguous core wall of said casting core;

said first, second, third and fourth rigid walls of said outer form and said internal contiguous core wall of said casting core being spaced apart to define a mold cavity therebetween;

a form base supported by the supporting slab and positioned within said mold cavity to releasingly support the cast concrete structure within the form;

said form base having an inner and outer edge;

means for bracing said internal contiguous core wall of said casing core during the pouring and curing of the concrete in said mold cavity;

whereby in use pivoting each rigid wall and said first, second, third and fourth rigid walls of said outer form outwardly relative to said first end of said rigid wall to a position less than vertical and retracting said internal contiguous core wall of said casting core to a first position enables the placement of the structural reinforcing within said mold cavity prior to adding concrete into said mold cavity;

said internal contiguous core wall of said casting core includes an upper and lower periphery;

said lower periphery of said internal contiguous core wall being spaced above the supporting slab to enable extension and retraction of said internal contiguous core wall of said casting core relative to said rigid walls of said outer form;

said lower periphery of said internal contiguous core wall of said casting core being adjacent said inner edge of said form base to sealingly abut said inner edge of said form base when said internal contiguous core wall of said casting core is extended and braced at a second position during pouring and curing of the concrete within said mold cavity;

whereby pivoting in use each rigid wall of said first, second, third and fourth rigid walls of said outer form to a substantially vertical position relative to the supporting slab and extending said internal contiguous core wall to said second position sealingly abuts said form base and aligns the structural reinforcing relative to said internal contiguous core wall of said casting core and each rigid wall of said first, second, third and fourth rigid walls of said outer form within said mold cavity prior to the pouring and curing of the concrete within said mold cavity; and whereby retracting in use said internal contiguous core wall of said casting core to a first position and pivoting each rigid wall of said first, second, third and fourth rigid walls of said outer form outwardly relative to said first end of each rigid wall of said first, second, third and fourth rigid walls to a position less than vertical after the cast reinforced concrete structure is cured enables the cast reinforced concrete structure to be easily released and removed from the form.

* * * * *

UNITED STATES PATENT AND TRADEMARK OFFICE

CERTIFICATE OF CORRECTION

PATENT NO. : 4,790,508

DATED : December 13, 1988

INVENTOR(S) : Henderson et al.

It is certified that error appears in the above-identified patent and that said Letters Patent is hereby corrected as shown below:

In the Specification

Column 1, line 13, delete "curved" and insert therefor --cured--.

Column 2, line 12, delete "of" and insert therefor --or--.

Column 2, line 67, delete "casing" and insert therefor --casting--.

Column 3, line 7, delete "internal" and insert therefor --within--.

Column 6, line 46, delete "internal" and insert therefor --within--.

Column 7, line 13, delete "casing" and insert therefor --casting--.

Column 7, line 17, delete "casing" and insert therefor --casting--.

Column 7, line 26, delete "casing" and insert therefor --casting--.

Column 10, line 2, delete "cage" and insert therefor --core--.

In the Claims

Claim 12, column 16, line 4, after "and" (second occurance) insert --said--.

Claim 14, column 17, line 21, delete "reracting" and insert therefor --retracting--.

UNITED STATES PATENT AND TRADEMARK OFFICE

CERTIFICATE OF CORRECTION

PATENT NO. : 4,790,508

DATED : December 13, 1988

INVENTOR(S) : Henderson et al

It is certified that error appears in the above-identified patent and that said Letters Patent is hereby corrected as shown below:

Claim 17, column 20, line 5, after "wall" delete "and".

Signed and Sealed this

Thirteenth Day of March, 1990

*Attest:*

JEFFREY M. SAMUELS

*Attesting Officer*

*Acting Commissioner of Patents and Trademarks*